US008002083B2

(12) United States Patent
McLoughlin et al.

(10) Patent No.: US 8,002,083 B2
(45) Date of Patent: Aug. 23, 2011

(54) SEARCH LINE RESCUE SYSTEM

(76) Inventors: John E. McLoughlin, Hauppauge, NY (US); Neocles G. Athanasiades, E. Setauket, NY (US); Kiam Meng Toh, Hauppauge, NY (US); Joseph V. Beltrani, Hauppauge, NY (US)

( * ) Notice: Subject to any disclaimer, the term of this patent is extended or adjusted under 35 U.S.C. 154(b) by 883 days.

(21) Appl. No.: 12/018,424

(22) Filed: Jan. 23, 2008

(65) Prior Publication Data

US 2009/0183945 A1 Jul. 23, 2009

(51) Int. Cl.
*A62B 5/00* (2006.01)

(52) U.S. Cl. ..... 182/100; 182/12; 182/16; 182/189; 182/190; 182/191

(58) Field of Classification Search ..... 182/5, 12, 182/13, 15–18, 70, 100, 189–191; 33/756, 33/759; 224/103, 162; 116/205, DIG. 17
See application file for complete search history.

(56) References Cited

U.S. PATENT DOCUMENTS

| | | | | |
|---|---|---|---|---|
| 257,781 | A * | 5/1882 | Sillivan | 182/73 |
| 4,235,306 | A * | 11/1980 | Ross et al. | 182/100 |
| 4,557,442 | A * | 12/1985 | Krezak et al. | 244/137.2 |
| 5,743,354 | A * | 4/1998 | Hunter | 182/100 |
| 5,988,101 | A * | 11/1999 | Jacobs et al. | 116/205 |
| 6,880,702 | B1 | 4/2005 | Colorado | |
| 7,175,908 | B2 * | 2/2007 | Connolly, Jr. | 428/378 |
| 2007/0245946 | A1 * | 10/2007 | Smith | 116/205 |

OTHER PUBLICATIONS

Author John R. Peleaux, "Prerigged Rope Rescue Systems," printed from www.innovative-access.com/rescue_articles.htm on Oct. 1, 2007, pp. 1-8, date unknown.
"Utilizing the Search Rope—Part 1," printed from www.firerescue1.com/print.asp?act=print&vid=309945 on Oct. 1, 2007, pp. 1-2, date unknown.
"View Full Version: Search Line Tactics," printed from forums.firehouse.com/archive/index.php/t-48722.html on Oct. 1, 2007, pp. 1-6, date unknown.
Color Drawing printed from www.iepfire.com/images/bags/jc30001.jpg on Oct. 2, 2007, date unknown.
IEP Fire Products, "HT2 High Temperature Search," printed from www.iepfire.com/ht2.htm on Oct. 2, 2007, pp. 1-2, date unknown.

(Continued)

*Primary Examiner* — Alvin Chin Shue
*Assistant Examiner* — Colleen M Quinn
(74) *Attorney, Agent, or Firm* — Wei Wei Jeang; Andrews Kurth LLP

(57) ABSTRACT

A search line rescue system for use by rescue personnel to facilitate a safe search and rescue mission through an area of low to zero visibility is disclosed. The search line rescue system comprises a search rope having a first end configured to be attachable to a fixed point at an entry point, a central portion with at least one distance marker and a second end. The system further comprises a search device handle with a leading end and a trailing end wherein the search device handle is slidably coupled to the search rope. The search device handle comprises a rigid body, an automatic lock mechanism coupled to the rigid body wherein the automatic lock mechanism comprises a manual lock mechanism release, and at least one tag line attachment anchor. At least one locking directional indicator is securely coupled to the search rope at a desired location, and is configured to releasably engage with the automatic lock search mechanism of the search device handle.

23 Claims, 3 Drawing Sheets

OTHER PUBLICATIONS

IEP Fire Products, "JC300 Large Area Search Bag," printed from www.iepfire.com/jc300.htm on Oct. 2, 2007, pp. 1-2, date unknown.
"RIT Rescue and Escape Systems," Group Search, pp. 1-3, date unknown.
"Rit Rescue—Escape Systems for Emergency Service Professionals," printed from www.ritrescuesystems.com/product_detail.php?id=14 on Oct. 2, 2007, pp. 1-2, date unknown.

* cited by examiner

SEARCH LINE RESCUE SYSTEM

BACKGROUND

Search lines made from rope are typically used by firefighters to stretch into a building as a safety line when there is heavy smoke and poor visibility. A firefighter can follow the search line out of the building if there is an emergency. The traditional system is fairly simple but has various drawbacks.

The search line is initially extended by a lead firefighter, who is normally equipped with full protective gear, SCBA and/or a thermal camera. The lead firefighter (officer, team leader) ties the search line rope to a sturdy object at the entrance of an area to be searched. Some rope may have pre-tied overhand knots approximately every twenty or twenty-five feet. The knots provide indication to the firefighter how far they have traveled into the area to be searched. Typically a single knot is tied to mark twenty-five feet, two knots to mark fifty feet, three knots for seventy-five feet, etc. This may continue to seven knots at one hundred seventy five feet or more.

It can be fairly tedious and somewhat complicated to correctly set up a search line in this manner. In addition, the knots do not provide the firefighters directional indication pointing to the entrance/exit if the firefighters become disoriented in dense smoke. Thus, in some systems additional knots or rings are added to provide directional indication. Having so many knots tied in the rope can cause jams when the rope is deployed from a typical rescue bag with a payout hole. A typical quick-deployment rope bag is disclosed by U.S. Pat. No. 6,880,702 to Colorado.

Finally, firefighters, usually two, each has a second short line called a tag line. The tag line is usually fifteen to twenty five feet long and is tied to the main search line at preset intervals so the firefighters can search within the radius of the tag line. In a typical setup, the officer/team leader ties large loops at set locations so the tag-line searchers can lock into and search in a set pattern off the main search rope. In summary, this typical search line system can be labor intensive, inefficient and confusing, leaving room for improvements.

SUMMARY

In one exemplary embodiment, a search line rescue system for use by rescue personnel to facilitate a safe search and rescue mission through an area of possible low to zero visibility. The search line rescue system comprises a search rope having a first end configured to be attachable to a fixed point at an entry point, a central portion with at least one distance marker and a second end.

The system further comprises a search device handle with a leading end and a trailing end wherein the search device handle is slidably coupled to the search rope. The search device handle comprises a rigid body, an automatic lock mechanism coupled to the rigid body wherein the automatic lock mechanism comprises a manual lock mechanism release, and at least one tag line attachment anchor. At least one locking directional indicator is securely coupled to the search rope at a desired location, and is configured to releasably engage with the automatic lock mechanism of the search device handle.

In another exemplary embodiment, a tactical search system for use by firefighters to facilitate a search and rescue mission is disclosed. The tactical search system comprises a handheld search device having a longitudinal bore therethrough, a search line passing through the longitudinal bore of the handheld search device which has at least one locking directional indicator, and at least one automatic locking mechanism coupled to the handheld search device. The automatic locking mechanism is operable to releasably engage the locking directional indicator, thereby stopping the displacement of the handheld search device along the search line.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

The disclosed device provides a novel and improved search line rescue system. The system discloses a device which slides over a rope that has preset markers on it. In addition, every twenty-five feet (or other preset distance) there is a locking directional indicator. The system will stop automatically and lock when it gets to this point. It will not allow searchers to proceed any further until they release the latch by squeezing the device.

Distance markers replace knots to indicate distance. For example, one distance marker is attached to the search rope at twenty-five feet, two distance markers are attached to the search rope at fifty feet, and so forth. The distance markers slide through the device without any locking. When the searchers stop at a lock point, they clip their tag lines to side holes included on the device. The searchers can then easily do a radius search of the corresponding area.

The distance markers are firmly attached to the rope with pins, screws, glue or something of the like. The distance markers are also designed with rounded corners so they don't get tangled on the rope. The system is quick to deploy from a deployment bag, and is less prone to jams. It is a novel and improved search system for firefighters and other rescue personnel.

Figure 2:
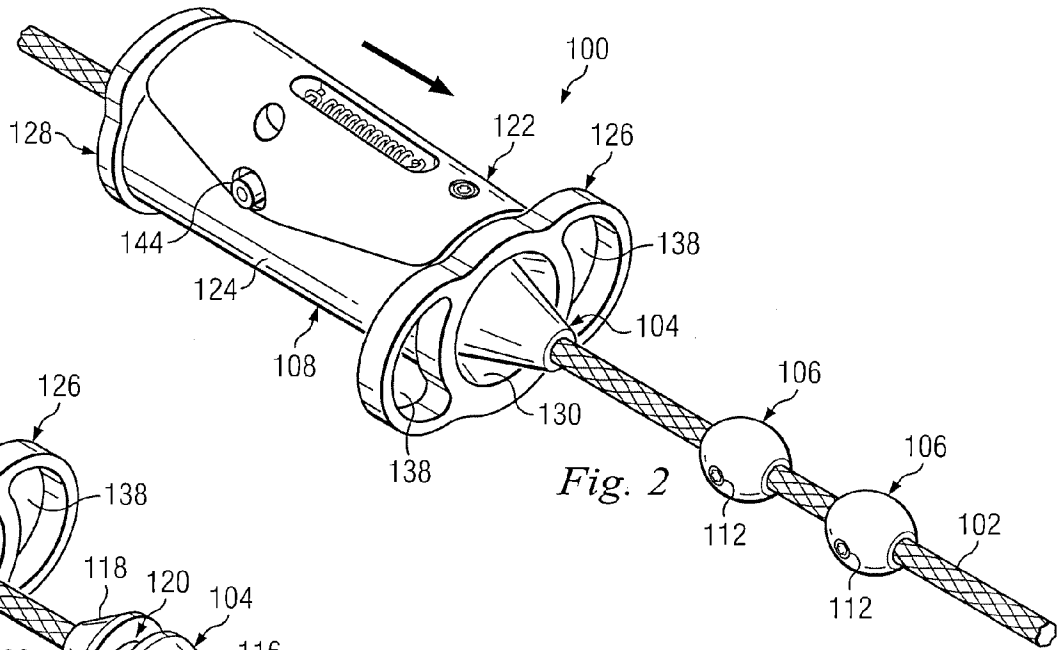
FIG. 2 is a front perspective view of the search line rescue system illustrating engagement with a locking directional indicator.
Figure 1:
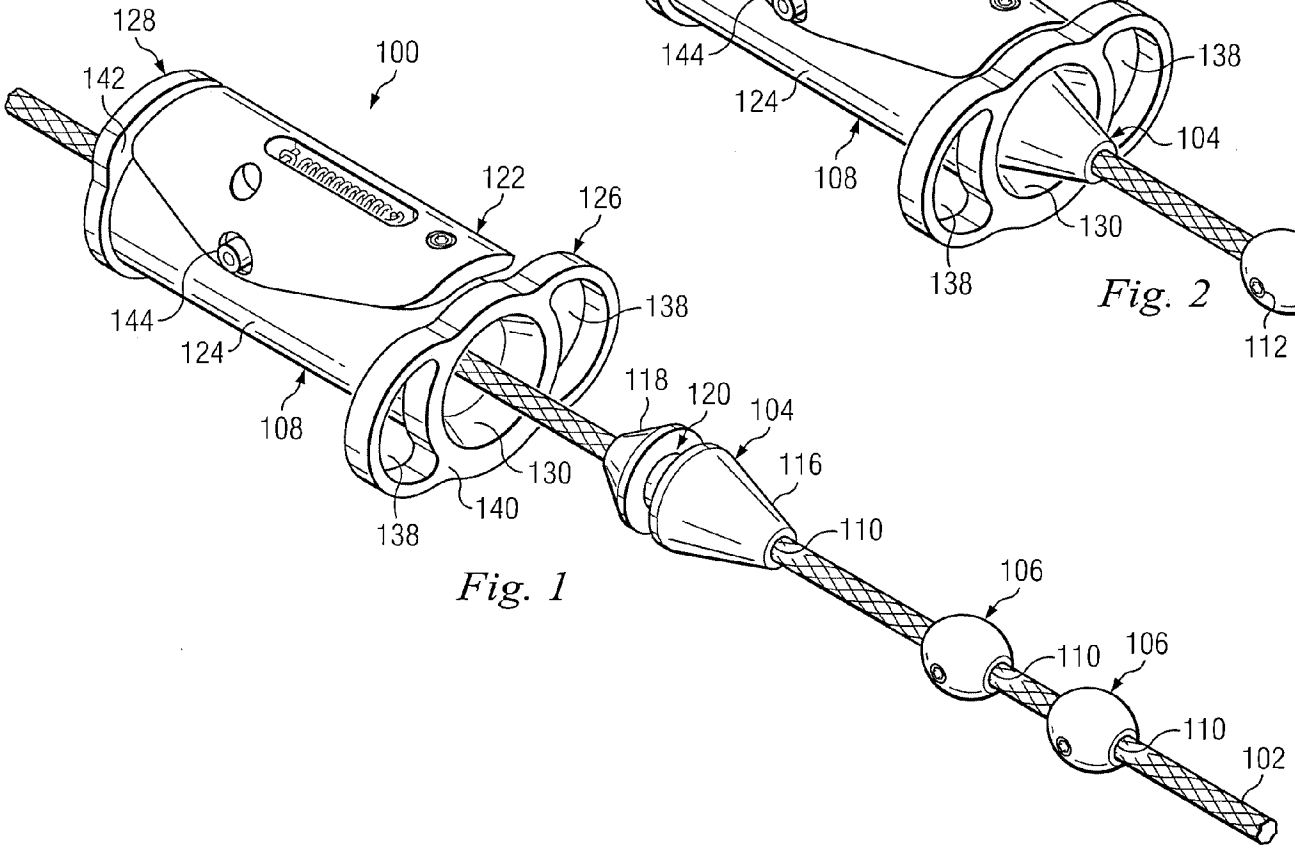
FIG. 1 is a front perspective view of a search line rescue system according to an exemplary embodiment.

Thus, the search line rescue system disclosed herein is designed to be quickly deployed and efficiently used during a search—especially in an area of reduced or no visibility. FIG. 1 shows a front perspective view of a search line rescue system according to an exemplary embodiment 100, and FIG. 2 shows the search line rescue system 100 in engagement with a locking directional indicator. A search rope 102 is pre-fitted with at least one locking directional indicator 104 and at least one distance marker 106. A search device handle 108 is also installed such that the search device handle 108 can travel back and forth along the search rope 102 without accidentally becoming separated from the search rope 102. In FIG. 1, the search device handle 108 is not "locked" on a locking directional indicator 104. FIG. 2 shows that the search device handle 108 has been advanced to a location where the search device handle 108 is releasably "locked" on a locking directional indicator 104.

The search rope 102 is generally described as a rope, but it can also comprise a cord, line or other flexible elongated member constructed from any one of a number of suitable materials. It may include other properties such as fire retardant, fire resistance, or fireproofing. In one embodiment, the search rope 102 is made from a rope having a KEVLAR® core surrounded by a polyester wrapping. Other core and/or wrapping materials are contemplated including materials such as nylon, cotton, metal strands, aramid and other suitable materials. The search rope 102 may have a ⅜" diameter, another standard diameter such as ¼", 5/16", ½", or another suitable or desirable thickness. The diameter may be determined based on the required length, strength and flexibility of a particular application. In other embodiments, the search rope 102 may comprise a braided wire cable or tubular webbing.

Figure 6:
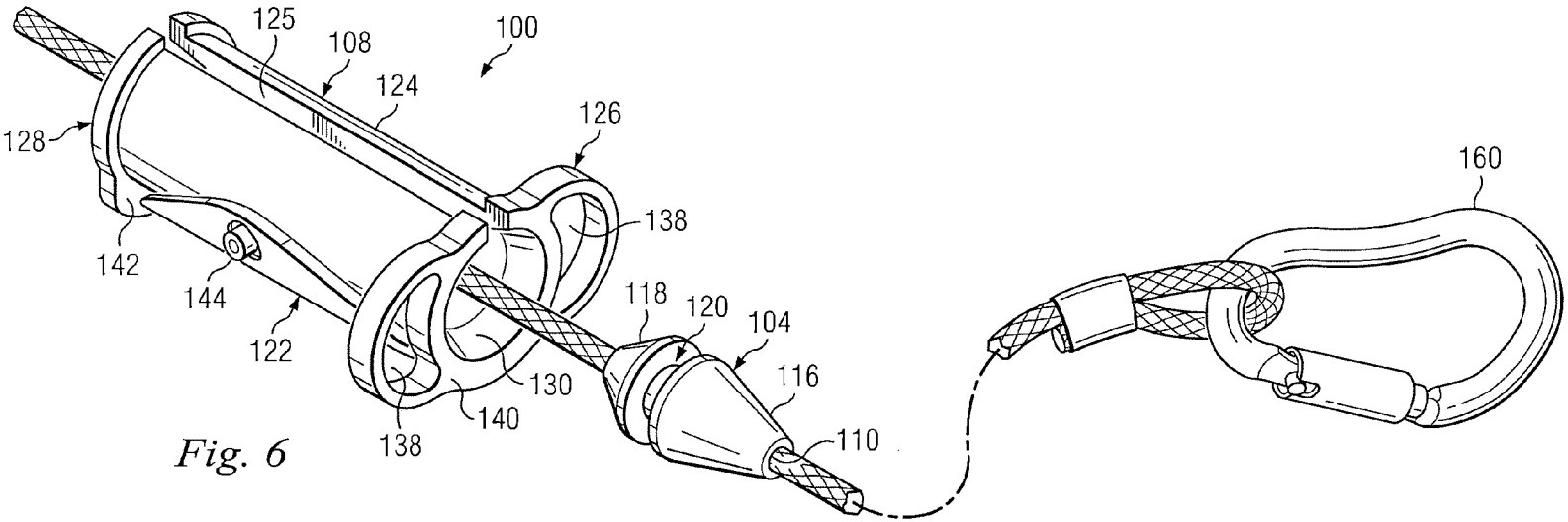
FIG. 6 is a front perspective view of another embodiment of the search line rescue system.

The search rope 102 has a first end that may be attached to an anchor point or structure at a search entry point. As shown in FIG. 6, the search rope 102 has a second end which has a snap hook, ring, carabiner, loop or other connector 160 which is attachable to a lead firefighter. Alternatively, the second end may be connected to a rope bag for rapid payout, wherein the rope bag is attached to the lead firefighter and has a payout hole for smoothly dispensing the search rope 102. The rope bag may be made from fire resistant materials or other standard, durable fabrics.

The central portion of the search rope 102 comprises at least one distance marker 106 securely affixed to the rope and at least one locking directional indicator 104 that can be displaced along the rope. In one exemplary embodiment, the search rope 102 comprises a single distance marker 106 at twenty-five feet from the first end of the rope, two distance markers 106 disposed at fifty feet, three distance markers 106 disposed at seventy-five feet, and so forth along the length of the search rope 102 which may reach two hundred feet or longer. Alternatively, the distance markers 106 may be disposed at other distance intervals and may even be equally spaced or non-equally spaced based on user preferences.

By attaching distance markers 106 to the search rope as described, a firefighter can "sense" or otherwise determine how far into the search area he has traveled, even while wearing protective gloves and having his vision obscured. For example, if the firefighter feels two distance markers 106, he will know he is fifty feet from the entrance. The distance markers 106 may include a central bore 110 sized to thread the distance markers 106 over the search rope 102. In an exemplary embodiment the distance markers 106 are secured along the search rope 102 with set screws 112. In other embodiments the distance markers 106 may be attached with pins, glue, retention rings, a friction fit, crimping, and the like.

In another embodiment, the distance markers 106 may be integrally formed in the rope, or with the rope; or, the distance markers 106 may comprise a slot or two combinable pieces allowing the distance markers 106 to be attached or crimped to the search rope 102 without the need for threading from the first or second end of the search rope 102.

Figure 3:
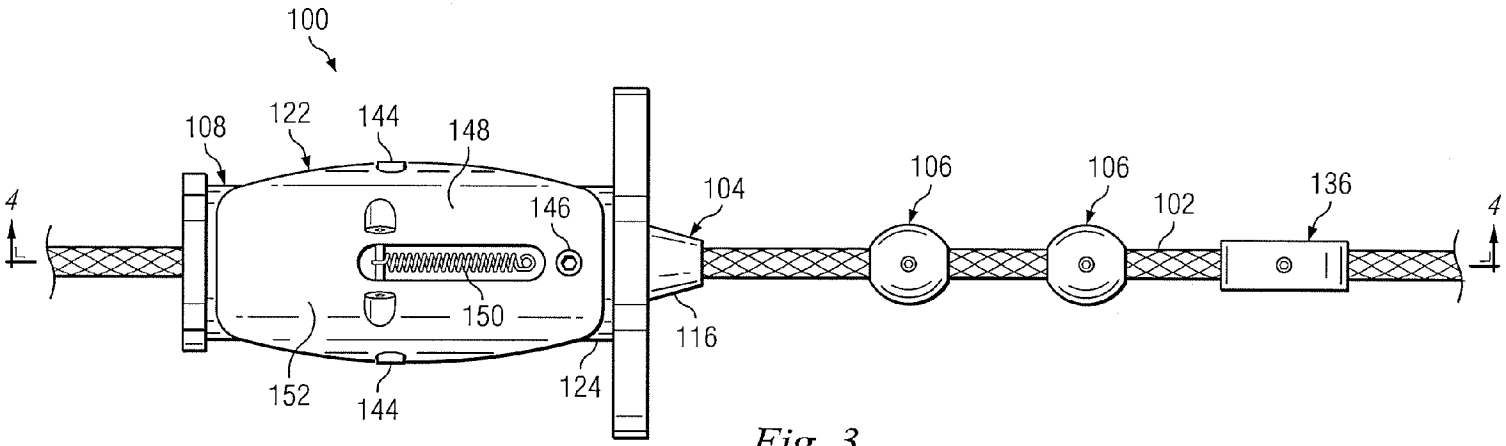
FIG. 3 is a plan view of a search line rescue system according to an exemplary embodiment.

The shape of the distance markers 106 preferably has rounded corners and edges to facilitate uncoiling and payout of the search rope 102. In a preferred embodiment, the distance markers 106 are generally spherical, or egg-shaped. Additional shapes are contemplated for the distance markers 106. Referring briefly to FIG. 3, which shows a plan view of a search line rescue system 100, an elongated distance marker 136 is shown. In one embodiment, an elongated distance marker, such as marker 136, is shaped generally as a rectangle and represents one hundred feet. Thus, by using various geometries, the distance markers 106, 136, and others may communicate information quickly via the firefighter's tactile senses.

In addition to the distance markers 106 shown in FIGS. 1 and 2, the search rope 102 further includes at least one locking directional indicator 104. In an exemplary embodiment, the search rope 102 comprises one locking directional indicator 104 at twenty-five feet, one locking directional indicator 104 at fifty feet, one locking directional indicator 104 at seventy-five feet, and so forth along the length of the search rope 102 which may reach two hundred feet or longer. Other user-defined spacing may also be used.

The locking directional indicators 104 may include a central bore 110 sized to thread the locking directional indicators 104 over the search rope 102. In a preferred embodiment the locking directional indicators 104 are secured along the search rope 102 with set screws 112. In other embodiments the locking directional indicators 104 may be attached with pins, glue, retention rings, a friction fit, crimping, and the like.

In another embodiment, the locking directional indicators 104 may be integrally formed in the rope, or with the rope; or, the locking directional indicators 104 may comprise a slot or two combinable pieces allowing the locking directional indicators 104 to be attached or crimped to the search rope 102 without the need for threading from the first or second end of the search rope 102.

The shape of the locking directional indicators 104 preferably has smooth edges to facilitate uncoiling and payout of the search rope 102. In a preferred embodiment, the locking directional indicator 104 has a generally tapered leading edge 116 and a generally tapered trailing edge 118. The "leading" direction generally points toward the second end of the search rope 102, which is into the search area and the "trailing" direction generally points toward the first end of the search rope 102, which is away from the search area.

It is a further preferred aspect of the locking directional indicator 104 to have a two-sided asymmetrical shape with one side indicating the direction towards an entrance point, and the other side indicating the direction away from an entrance point. In the embodiment shown in FIG. 1, the leading edge 116 is tapered more gently than the trailing edge 118.

Thus, by using geometric asymmetry, a firefighter can "feel" or otherwise determine the direction pointing towards the exit, even while wearing protective gloves and having his vision obscured. Geometric asymmetry can also be used by consistently placing the locking directional indicators 104 towards the same end of the search rope 102 relative to the distance markers 106.

Figure 4:
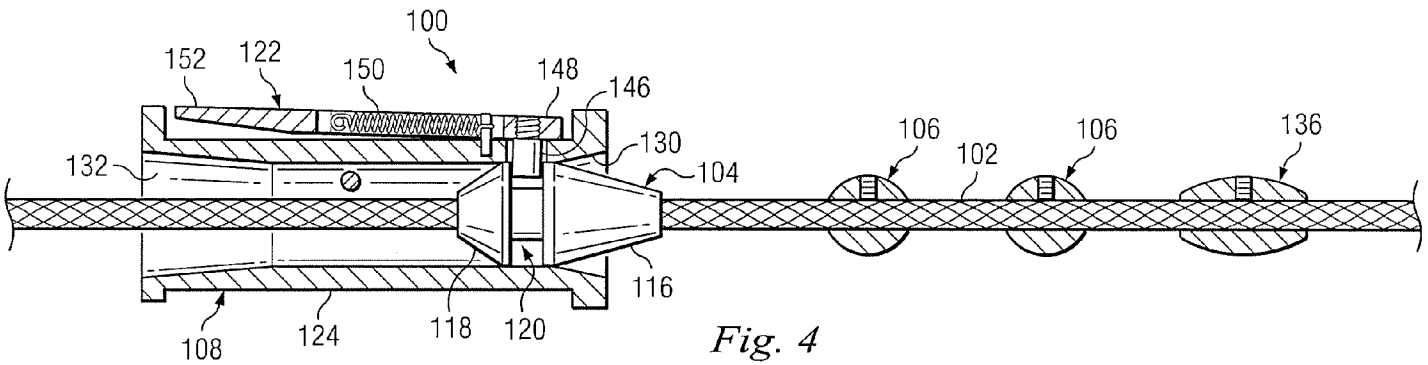
FIG. 4 is a cross-sectional view of the search line rescue system taken along line 4-4 thereof.

A further feature of the locking directional indicator 104 is a notch 120 configured to releasably engage with an automatic lock mechanism 122 which will be described with reference to FIGS. 3 and 4 below. FIG. 4 shows a is a cross-sectional view of the search line rescue system taken along line 4-4 thereof. The notch 120 may be a circumferential groove with a channel cross-section as shown in FIGS. 1 and 2, or it may be non-circumferential with a radiused cross-section. Other cross-sectional profiles and arrangements are also contemplated to accomplish the function of cooperating with the automatic lock mechanism 122.

The locking direction indicators 104 and distance markers 106 preferably comprise a rigid material such as plastic, rubber or metal. In one preferred embodiment they are made from aluminum and include an anodized coating for wear resistance.

The search rope 102 is further fitted with a search device handle 108. The search device handle 108 can travel back and forth along the search rope 102 without accidentally becoming separated from the search rope 102. The search device handle 108 is preferably shaped as an elongated device, long enough for a secure grip by a gloved firefighter. In FIGS. 1 and 2, the search handle 108 is disclosed as a hollow rigid body 124 with a leading portion 126 and a trailing portion 128.

The hollow rigid body 124 of the search device handle 108 may have a circular, oval, or other cross-sectional shape. As shown in FIGS. 1 and 2, the hollow rigid body 124 has a circular cross-section that is sufficiently sized to allow the distance markers 106 to pass through without interfering with the automatic lock mechanism 122. The hollow rigid body 124 has internal tapers 130 and 132 at the leading and trailing ends, respectively, to facilitate entry of the locking directional indicator 104 in either direction.

In an alternative configuration, the hollow rigid body 124 may have a longitudinal slot 125, shown in FIG. 6, which allows the search device handle 108 to be laterally engaged onto the search rope 102. In yet another embodiment the hollow rigid body 124 comprises a first and second half portions which can quickly be removably attached to each other around the search rope 102.

The leading portion 126 and trailing portion 128 of the hollow rigid body 124 are now discussed. The leading portion 126 and trailing portion 128 may be integrally formed with the hollow rigid body 124 or they may be separate components securely attached thereto. In an exemplary embodiment, the leading and trailing portions 126, 128 have raised edges 140, 142 to prevent slipping of a firefighter's gloved hand. In other embodiments the search device handle 108 may be treated to prevent slipping such as by metal knurling and/or rubber coating.

The search device handle 108 and its various components are preferably constructed of a sufficiently rigid and sturdy material such as plastic, rubber or metal. In an exemplary embodiment the search device handle is made from aluminum or and aluminum composite which may include an anodized coating for wear resistance. The various components of the search device handle 108 may also be constructed from, or coated with, corrosion and heat resistant material.

In a preferred embodiment, the leading portion 126 comprises at least two tag line attachment openings or attachment points 138. The tag lines are typically shorter than the main search rope 102 and provide for arterial searches on either side of the search rope 102. Typically, the tag lines will have a quick connect such as a snap hook, carabiner, or the like, for quickly and securely attaching the tag lines to the search device handle 108 via the attachment holes 138. Each tag line is generally stored its own corresponding deployment bag.

Figure 5:
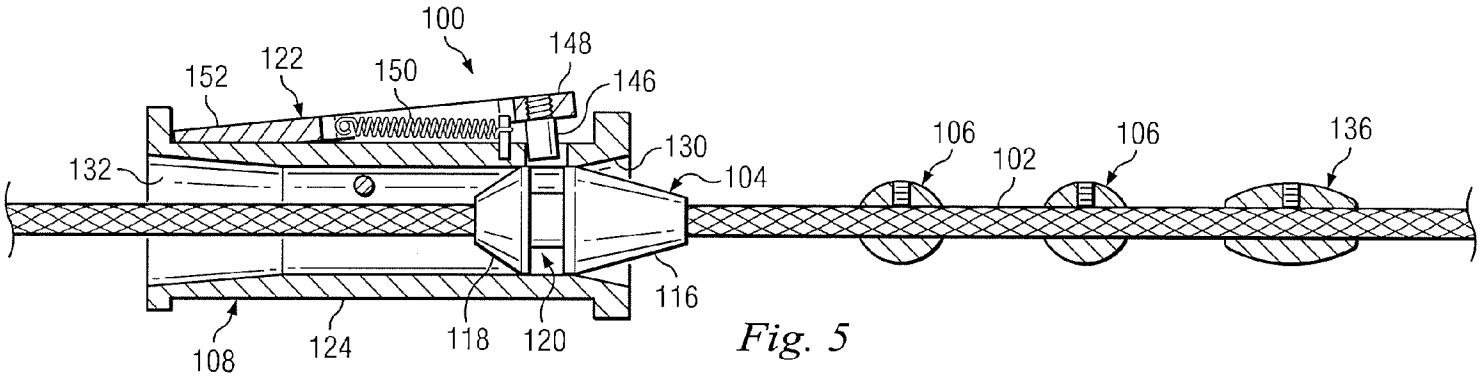
FIG. 5 is a cross-sectional view of the search line rescue system taken along line 4-4 thereof.

Referring now to FIGS. 3-5, additional details of the search device handle 108 are shown. The automatic lock mechanism 122 may be attached to the hollow rigid body 124 of the search device handle 108 by hinge pins 144. The automatic lock mechanism 122 comprises a locking pin 146 attached to a spring activated member 148. A spring 150 is mounted at a first end to the hollow rigid body 124 and at a second end to the spring activated member 148. Thus, spring 150 is arranged to keep the automatic lock mechanism 122 in a normally closed position, such as that shown in FIG. 4. As the hollow rigid body 124 advances to the locking direction indicator 104, the locking pin 146 rides up the trailing taper 118 until the locking pin 146 aligns with the groove (or notch) 120.

The spring 150 causes the locking pin 146 to drop into the groove 120, thereby preventing further advancement or retreat of the search device handle 108. A lever portion 152 of the automatic lock mechanism 122 extends from the trailing side of the spring activated member 148 and functions as a lock release. FIG. 5 shows a cross-sectional view of the search line search system 100 taken along line 4-4 thereof. However, FIG. 5 shows the lever portion 152 depressed. Depression of lever portion 152 pivots the spring activated member 148 away from the groove 120 of the locking directional indicator 104, thereby allowing the search device handle 108 to be advanced to the next locking direction indicator in either direction.

In one embodiment the locking pin 146 of the search device handle 108 is a cylindrical pin. In another embodiment, the locking pin 146 is hemisphere-shaped designed to lock in a radiused groove.

A method for using the device is now given with reference to the previously described embodiments. Before entering a search area, the main search rope 102 is secured at a safe entrance/exit point. The main search rope 102 is then deployed into the area by a lead firefighter or rescuer. The search device handle 108 is advanced from the entrance by one of the firefighters. The search device handle 108 will automatically lock at the first locking directional indicator 104. For example, the first locking directional indicator 104 may be located twenty feet into the search area.

If two rescuers are available, they may attach a tag line on either side of the search rope 102 at the search device handle attachment holes 138. As the two rescuers each travel away from the locked search device handle 108 to the extent of their tag lines, the areas adjacent to the main search rope 102 are searched. The search device handle 108 may then be released from the first directional indicator 104 by depressing the lever portion 152 and the search device handle 108 is advanced to the next locking directional indicator 104.

Thus, the search continues, ideally until the end of the search rope 102 is reached or the area is safely searched. In low to zero visibility, disorientation may occur. A disoriented rescuer or survivor may quickly determine the route to a safe exit by sliding a hand along the main search rope 102 until a locking directional indicator 104 is felt. The locking directional indicator 104 will point the rescuer or survivor to the safe exit. Thus, a safe egress is facilitated by evacuating close to the main search rope 102 in the direction indicated.

Although embodiments of the present disclosure have been described in detail, those skilled in the art should understand that they may make various changes, substitutions and alterations herein without departing from the spirit and scope of the present disclosure. Accordingly, all such changes, substitutions and alterations are intended to be included within the scope of the present disclosure as defined in the following claims. In the claims, means-plus-function clauses are intended to cover the structures described herein as performing the recited function and not only structural equivalents, but also equivalent structures.

The invention claimed is:

1. A search line rescue system for use by rescue personnel to facilitate a safe search and rescue mission through an area of possible low visibility, comprising:

a search rope having a first end, a central portion and a second end, the first end configured to be attachable to a fixed point at an entry point, the central portion comprising at least one distance marker;

a search device handle having a leading end and a trailing end, the search device handle being slidably coupled to the search rope, the search device handle comprising:

a rigid body;

an automatic lock mechanism coupled to the rigid body, the automatic lock mechanism comprising a manual lock release; and at least one tag line attachment anchor; and at least one locking directional indicator securely coupled to the search rope at a desired location, the locking directional indicator configured to releasably engage with the automatic lock mechanism of the search device handle.

2. The search line rescue system of claim 1, wherein the search rope is constructed from at least one fire retardant material.

3. The search line rescue system of claim 1, wherein the search rope further comprises a connector on the second end.

4. The search line rescue system of claim 1, wherein the central portion of the search rope further comprises a plurality of distance markers securely coupled to the search rope at known spacing therebetween.

5. The search line rescue system of claim 4, wherein each distance marker has rounded corners and edges.

6. The search line rescue system of claim 4, wherein the plurality of distance markers are equally spaced along the search rope.

7. The search line rescue system of claim 6, wherein at least a first one of the plurality of distance markers is of a first shape and at least a second one of the plurality of distance markers is of a second shape.

8. The search line rescue system of claim 1, wherein the automatic lock mechanism comprises a locking pin coupled to a spring activated member.

9. The search line rescue system of claim 1, wherein the manual lock release comprises a lever portion extending from the automatic lock mechanism.

10. The search line rescue system of claim 1, wherein the rigid body of the search device handle is sufficiently sized to allow the distance marker to pass therethrough without interfering with the automatic lock mechanism.

11. The search line rescue system of claim 1, wherein the rigid body has internal tapers at the leading and trailing ends to facilitate passing through of the locking directional indicator.

12. The search line rescue system of claim 1, wherein the search device handle further comprises raised edges at the leading and trailing ends to prevent slipping of a firefighter's gloved hand.

13. The search line rescue system of claim 1, wherein the search device handle further comprises at least two tag line attachment anchor openings on the leading end of the search device handle.

14. The search line rescue system of claim 1, wherein the rigid body of the search device handle has a longitudinal slot which allows the search device handle to be laterally engaged onto the search rope.

15. The search line rescue system of claim 1, wherein the rigid body comprises a first and second half which can quickly be removably coupled to each other around the search rope.

16. The search line rescue system of claim 1, wherein the search device handle, distance markers and locking directional indicator comprise corrosion-resistant materials.

17. The search line rescue system of claim 1, wherein the locking directional indicator has leading and trailing ends with different tapered geometries.

18. The search line rescue system of claim 1, wherein a plurality of locking directional indicators are coupled to the search rope at user-defined intervals.

19. A tactical search system for use by firefighters to facilitate a search and rescue mission, comprising:

a handheld search device having a longitudinal bore therethrough;

a search line comprising at least one locking directional indicator, wherein the search line passes through the longitudinal bore of the handheld search device; and at least one automatic locking mechanism coupled to the handheld search device operable to releasably engage the locking directional indicator, thereby stopping the displacement of the handheld search device along the search line.

20. The tactical search system of claim 19, wherein the handheld search device comprises at least one attachment point for arterial search lines.

21. The tactical search system of claim 19, wherein the locking directional indicator has a two-sided asymmetrical shape with one side indicating the direction towards a first end of the search line and the other side indicating the direction toward the second end of the search line.

22. The tactical search system of claim 19, further comprising a plurality of distance markers securely coupled to the search line at known intervals.

23. A tactical search system, comprising:

a search line;

a plurality of locking directional indicators securely coupled to the search line at predetermined locations;

a handheld grip device displaceably coupled to the search line, the handheld grip device comprising an automatic lock mechanism operable to releasably engage one of the plurality of locking directional indicators; and a plurality of distance markers securely coupled to the search line at predetermined intervals.

* * * * *